US008584880B2

(12) United States Patent
Ferraccioli

(10) Patent No.: US 8,584,880 B2
(45) Date of Patent: Nov. 19, 2013

(54) DUMPSTER FOR HOLDING WASTE MATERIAL

(76) Inventor: Luca Ferraccioli, I-Sant' Agostino (IT)

( * ) Notice: Subject to any disclaimer, the term of this patent is extended or adjusted under 35 U.S.C. 154(b) by 0 days.

(21) Appl. No.: 13/510,288

(22) PCT Filed: Nov. 15, 2010

(86) PCT No.: PCT/IB2010/002903

§ 371 (c)(1),
(2), (4) Date: Jul. 30, 2012

(87) PCT Pub. No.: WO2011/058429

PCT Pub. Date: May 19, 2011

(65) Prior Publication Data

US 2012/0279886 A1 Nov. 8, 2012

(30) Foreign Application Priority Data

Nov. 16, 2009 (IT) ..... BO2009A0742

(51) Int. Cl.
*B65D 88/00* (2006.01)

(52) U.S. Cl.
USPC ..... 220/1.5; 220/662; 220/676; 220/908

(58) Field of Classification Search
USPC ..... 220/1.5, 662, 676, 908
See application file for complete search history.

(56) References Cited

U.S. PATENT DOCUMENTS 4,768,670 A 9/1988 Lin
8,348,081 B2 * 1/2013 Baptiste ..... 220/345.1
2009/0119113 A1 5/2009 Dancy

FOREIGN PATENT DOCUMENTS

DE 943 513 C 5/1956

OTHER PUBLICATIONS

PCT International Search Report for PCT Counterpart Application No. PCT/IB2010/002903, 4 pgs (Mar. 31, 2011).
PCT Written Opinion of the International Search Authority for PCT Counterpart Application No. PCT/IB2010/002903, 6 pgs (Mar. 31, 2011).

* cited by examiner

*Primary Examiner* — Jeffrey Allen
(74) *Attorney, Agent, or Firm* — Blakely Sokoloff Taylor & Zafman LLP

(57) ABSTRACT

A dumpster for holding waste material has a cup-shaped body, a lid and one or more hooking means, which are suitable to connect the dumpster to a waste collection device; the dumpster has one or more openings obtained in the body or in the lid and has one or more inserts, each of which is suitable to close a corresponding opening; each insert comprises a plate made of translucent material and is provided, in turn with a fixing system; the fixing system having at least one damping means suitable to attenuate vibration movements of the plate.

9 Claims, 5 Drawing Sheets

DUMPSTER FOR HOLDING WASTE MATERIAL

CROSS-REFERENCE TO RELATED APPLICATIONS

This patent application is a U.S. National Phase Application under 35 U.S.C. §371 of International Application No. PCT/IB2010/002903, filed Nov. 15, 2010, entitled DUMPSTER FOR HOLDING WASTE MATERIAL, which claims priority to Italian Patent Application No. BO2009A000742, filed Nov. 16, 2009.

TECHNICAL FIELD

The present invention relates to a dumpster for holding waste material, in particular for holding any kind of urban waste material, whether for recycling or not.

BACKGROUND ART

A dumpster of the type described above generally comprises a cup-shaped body made of an opaque material that conceals the contents of said dumpster.

The dumpster of the type described above has the drawback of preventing the refuse collector from being able to see how full the dumpster is. Therefore, dumpster emptying operations are performed regardless of how full the dumpster is and, in particular, they are even performed when the dumpster is empty or not very full.

The use of a dumpster of the type described above involves high operating costs, in that it requires the use of equipment and labour even when not necessary.

DISCLOSURE OF INVENTION

According to the present invention there is provided a dumpster for holding waste material according to that claimed in claim 1 and, preferably, in any one of the subsequent claims depending directly or indirectly on claim 1.

BRIEF DESCRIPTION OF THE DRAWINGS

The present invention will now be described with reference to the accompanying drawings, illustrating some non-limiting embodiments thereof, in which.

BEST MODE FOR CARRYING OUT THE INVENTION

Figure 1:
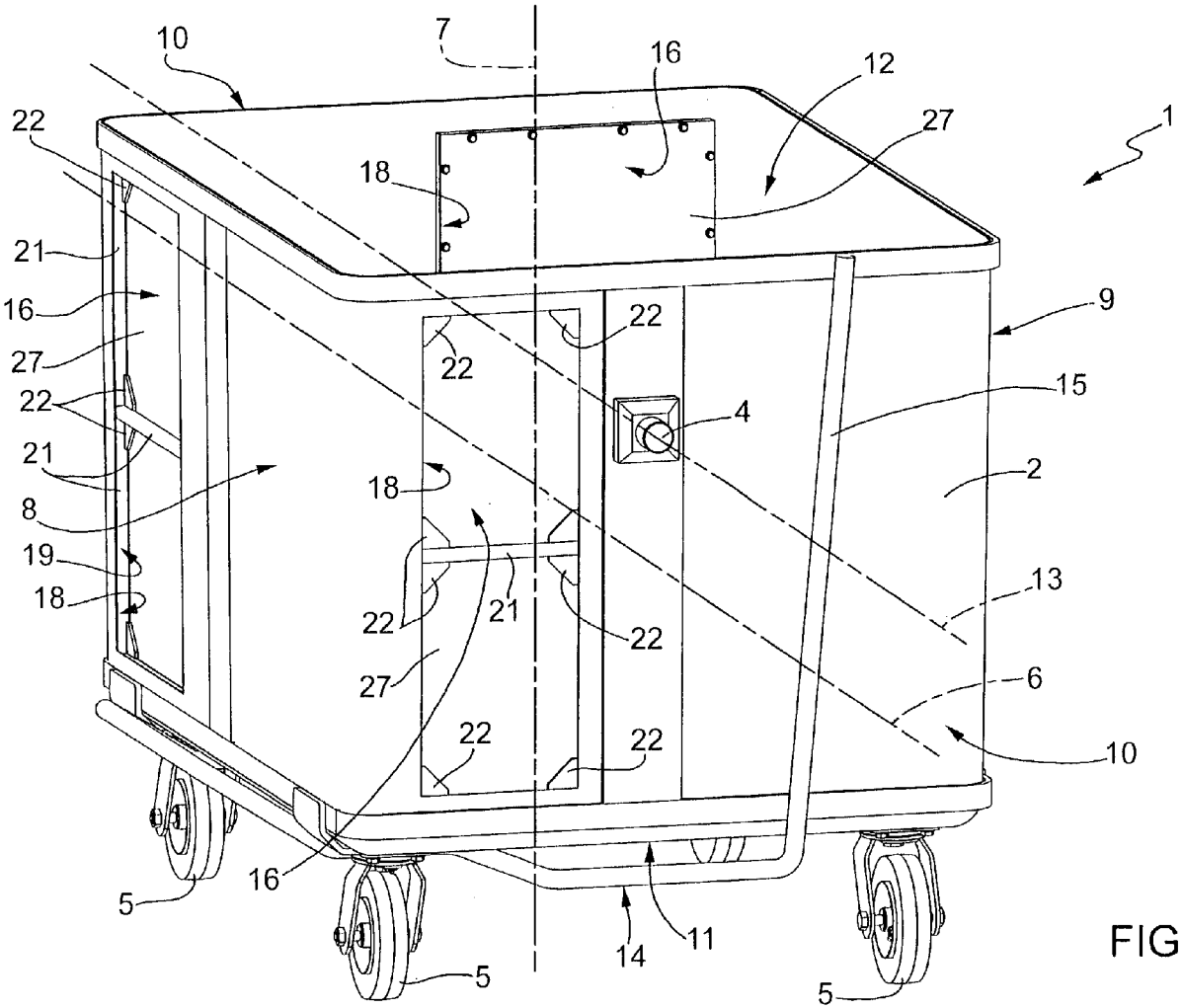
FIG. 1 is a perspective view, with parts removed for the sake of clarity, of a preferred embodiment of the present invention.

In FIG. 1 designated as a whole by number 1 is a dumpster for holding waste material comprising a cup-shaped body 2, a lid 3 (FIG. 2), a pair of hooking means 4, which are suitable to connect the dumpster 1 to an automatic waste collection device, for example a waste collection vehicle, and a plurality of wheels 5. The body 2 is substantially parallelepiped in shape with a longitudinal axis 6 and a vertical axis 7 and comprises a front wall 8, a rear wall 9, a pair of side walls 10, a bottom wall 11 and an upper opening 12. The front wall 8 and the rear wall 9 are larger in size than the side walls 10.

The lid 3 is hinged (in a conventional manner, not illustrated) to the rear wall 9 in correspondence with the opening 12.

The hooking means 4 are of a conventional type, each fixed to a respective side wall 10 and aligned with respect to one other along an axis 13 parallel to the longitudinal axis 6. In particular, each hooking means 4 is substantially cylindrical in shape and protrudes outwards from the body 2. The hooking means 4 are suitable for coupling the dumpster 1, in a conventional manner, not illustrated, to a conventional waste collection vehicle (not illustrated), during an operation to empty said dumpster 1.

The dumpster 1 also comprises a conventional pedal device 14, which is hinged to both of the side walls 10 and is connected to the dumpster 1, in a conventional manner, not illustrated, in proximity to the bottom wall 11.

The pedal device 14 comprises one or more rods 15, which are connected to the lid 3 and extend in a conventional manner along the outside of the dumpster 1 and longitudinally in relation to a respective side wall 10. In particular, the pedal device 14 is suitable to raise the lid 3, in a conventional manner, from a closed position to an open position. The wheels 5 are connected in a conventional manner to the bottom wall 11 of the dumpster 1.

Lastly, the dumpster 1 comprises one or more inserts 16, which are suitable to close the openings 18 obtained in the body 2 or in the lid 3 of the dumpster 1, as described in more detail below.

Figure 3A:
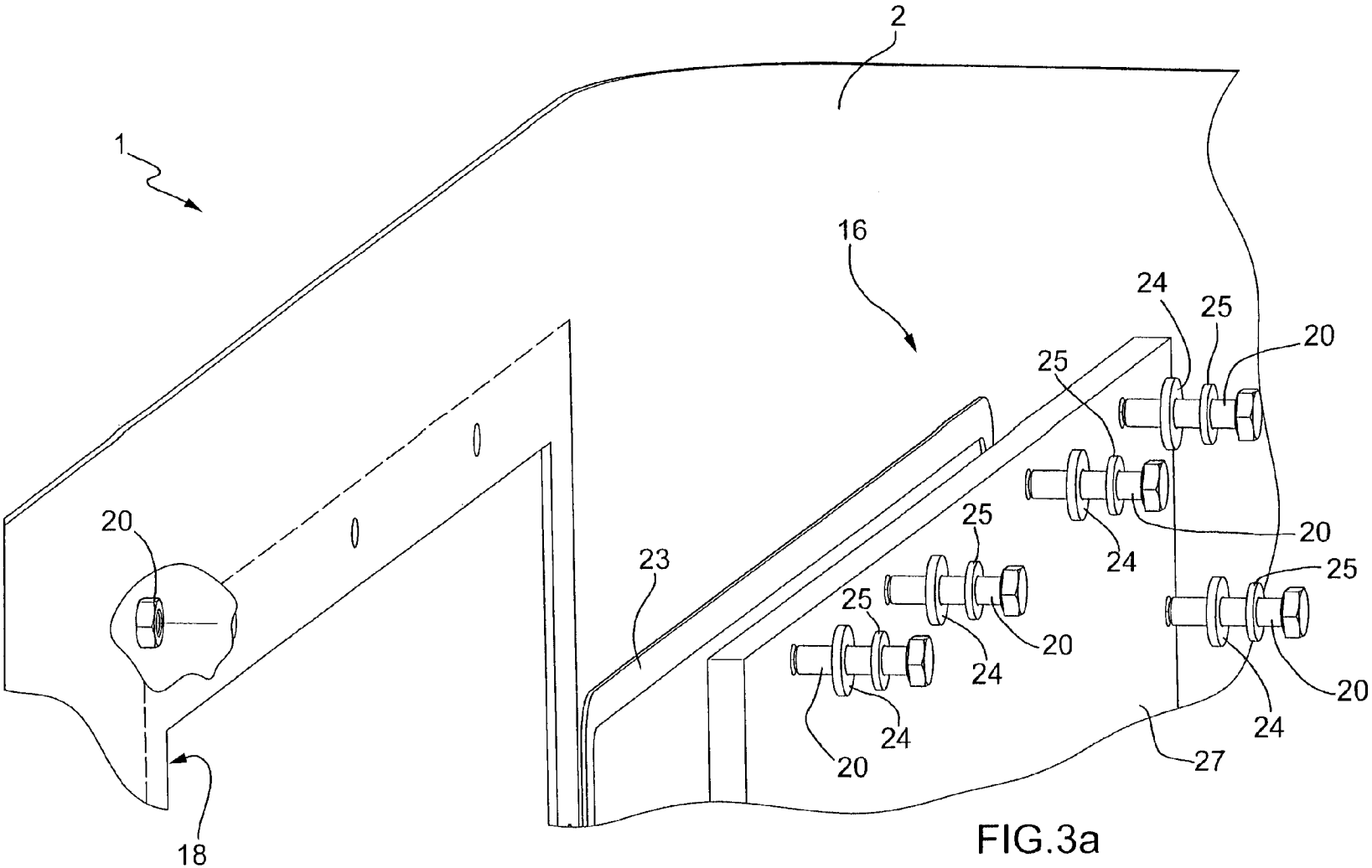
FIG. 3*a* is an exploded view of a detail of FIG. 1.

According to that illustrated in FIG. 3*a*, an insert 16 comprises a plate 27 made of translucent material and a fixing system, which connects said plate 27 to the dumpster 1. The plate 27 is preferably made of a plastic material or PLEXIGLAS.

According to that illustrated in FIG. 3*a*, the fixing system comprises a sealing element 23, which is arranged between the plate 27 and the dumpster 1, a plurality of connecting elements 20 and a respective plurality of damping means 24, each of which is fixed to a respective connecting element 20, as described in more detail below, and is placed in contact with the plate 27.

The sealing element 23 is suitable to be pressed in a conventional manner between the plate 27 and the body 2, so as to prevent any material leaking out of the dumpster 1.

Preferably, the connecting elements 20 are screws provided with washers 25 and the damping means 24 are elastic annular elements, in particular gaskets. According to that illustrated in FIGS. 3*a* and 3*b*, each damping means 24 has a respective connecting element 20 passing through it and is pressed by a relative washer 25 against the plate 27.

According to an alternative embodiment, not illustrated, a damping means 24 comprises at least one elastic spring-back element; for example, a damping means 24 comprises a spring device. Each damping means 24 is suitable to reduce the vibrations of the plate 27 during emptying operations, so that the stress on said plate 27 is significantly reduced.

Figure 3B:
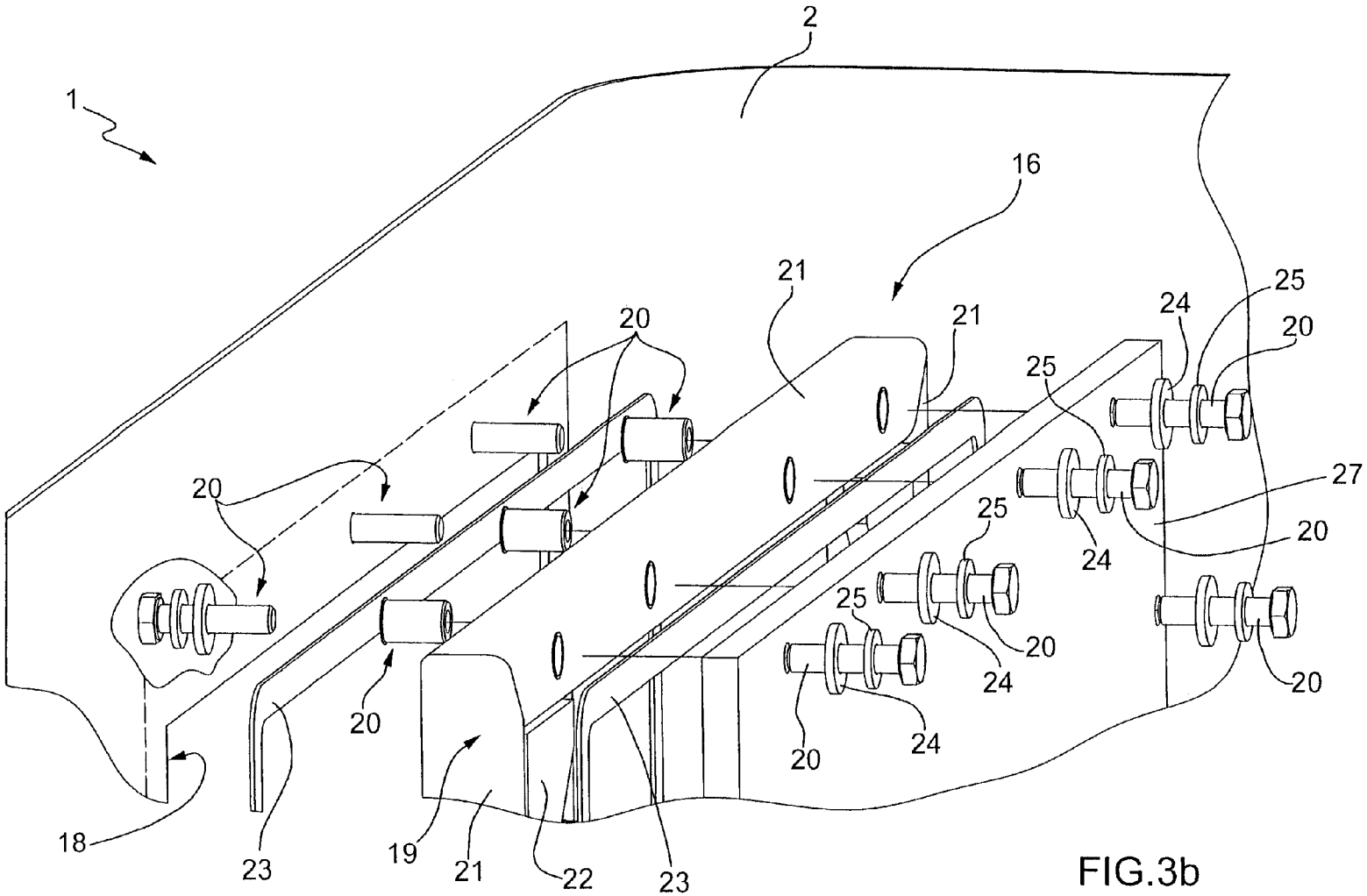
FIG. 3*b* illustrates an alternative embodiment of FIG. 3*a*.

According to that illustrated in FIG. 3*b* the fixing system comprises a frame 19, which is fixed to the dumpster 1 in correspondence with a respective opening 18. In particular, the fixing system illustrated in FIG. 3*b* comprises a plurality of connecting elements 20, a respective plurality of damping means 24, a sealing element 23, arranged between the dumpster 1 and the frame 19, which is arranged between the plate 27 and said dumpster 1, and a sealing element 23 placed between the plate 27 and the frame 19.

In particular, the frame 19 comprises a plurality of rigid branches 21, which are connected to one another to form a reticular structure and are substantially made of a metal material. The frame 19 also comprises angular reinforcing elements 22, each of which is arranged in correspondence with a respective crossing of at least two branches 21 of said frame 19.

The plate 27 is coupled to the frame 19; the plate is attached to the frame 19 by means of screws (FIGS. 3*a* and 3*b*) or by geometric interference (FIG. 4); likewise, each frame 19 is connected to the dumpster 1 by means of conventional systems, for example by means of rivets, screws or welding.

The form and dimensions of the frame 19 are determined by the size and position of the relative opening 18; in particular, the frame 19 is suitable to maintain or even increase the robustness of the dumpster 1.

Figure 4:
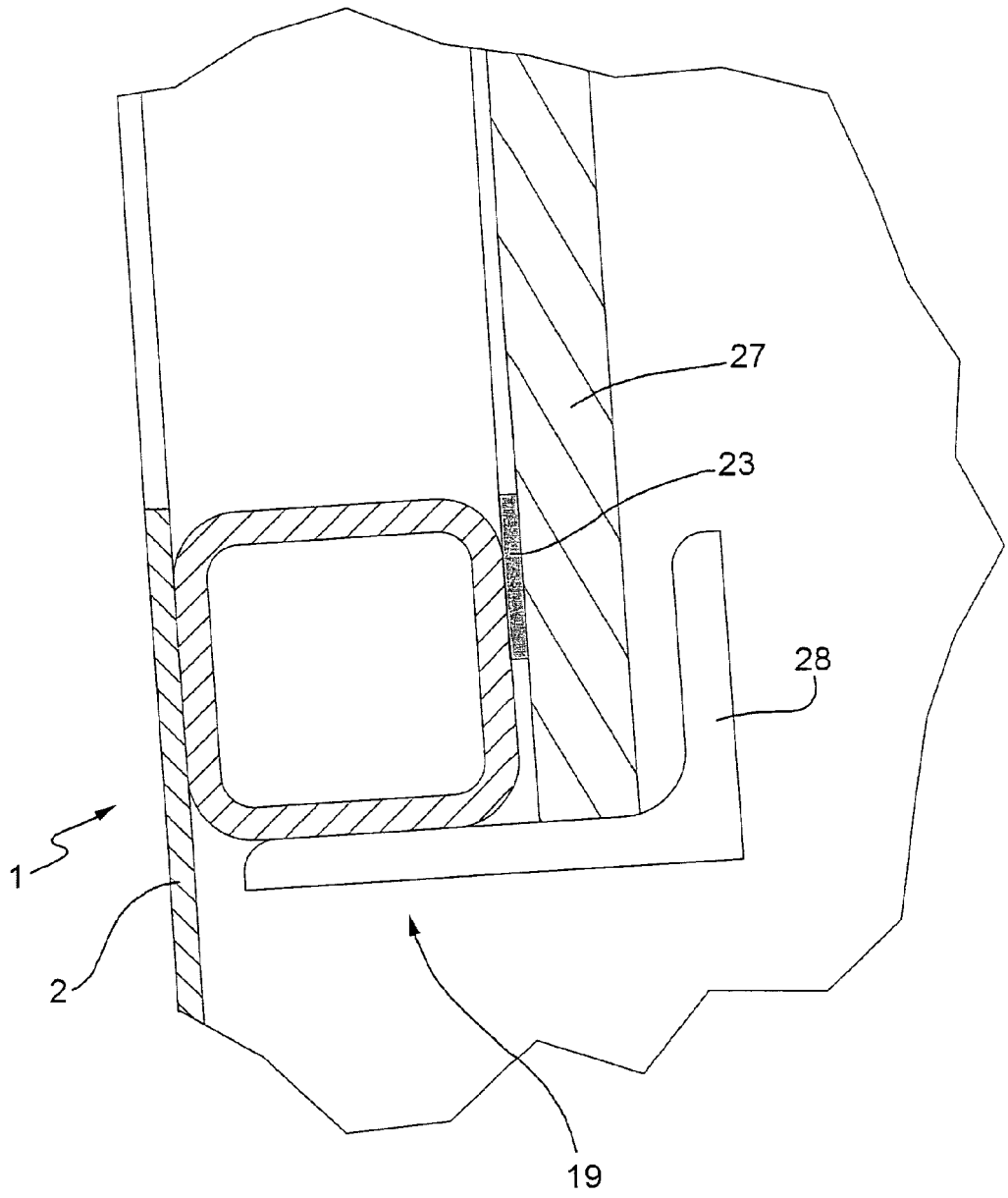
FIG. 4 is a cross-sectional view of an alternative embodiment of the detail of FIG. 1.

According to the alternative embodiment illustrated in FIG. 4, the frame 19 comprises at least one guide 28, to which the plate 27 is slidingly coupled.

According to that illustrated in FIG. 1, the dumpster 1 has a plurality of inserts 16 that are fixed to the body 2; moreover according to an alternative embodiment, not illustrated, at least one insert 16 is fixed by means of the methods described above to the lid 3.

Figure 2:
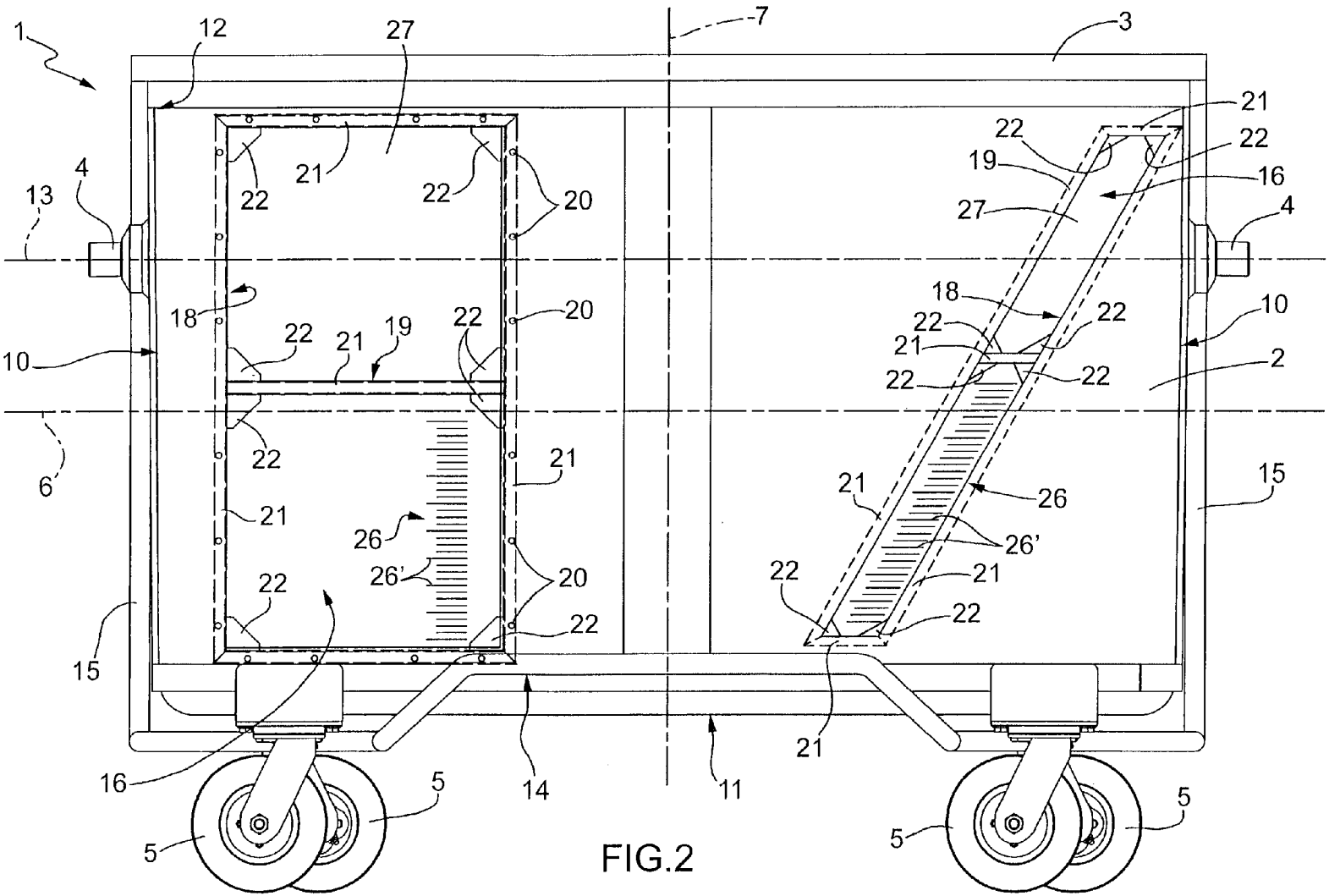
FIG. 2 is a side view of an alternative embodiment of FIG. 1.

According to that illustrated in FIG. 2, each insert 16 is chosen from within a set of inserts 16 having different forms and dimensions. For example, each insert 16 has one of the following shapes: L, U, V or polygonal.

According to FIG. 2, each plate 27 has a graduated scale 26 to indicate the level of the waste in the dumpster 1 and arranged along the vertical axis 7, with the insert 16 fitted. In other words, each plate 17 is provided with one or more notches 26' placed at a distance from each other along the vertical axis 7.

According to an alternative embodiment, not illustrated, each insert 16 is hinged along one side to the dumpster 1 so that a side opposite the hinged side can be arranged in an open position or in a closed position.

According to an alternative embodiment, not illustrated, the insert 16 also comprises a metal net which is arranged over the plate 27, so as to reinforce it. Alternatively, the metal net is fitted to the frame 19.

In use, one or more openings 18 are obtained on the cup-shaped body 2 and/or on the lid 3; the dumpster 1 is then prepared to receive the insert 16. In particular, the dumpster 1 is treated in proximity to the openings 18 to which the insert 16 is to be fitted, for example tapping operations are performed. Each insert 16 is then selected from within a set of inserts of different forms and dimensions according to the opening 18 to which it is to be fitted; lastly, the insert 16 is fitted to the dumpster 1 so as to close the respective opening 18.

From the above description it is apparent that an operator is able to see inside the dumpster 1 and calculate the level of waste in said dumpster 1, in order to decide whether or not to empty it. This prevents the performance of emptying operations when the dumpster 1 is practically empty.

Moreover, the dumpster 1 of the type described above has a structure that is capable of withstanding the stress that is generated during emptying operations; in particular, the dumpsters 1 can be used in place of those currently in use.

What is claimed is:

1. A dumpster for holding waste material comprising a cup-shaped body, a lid and one or more hooking means, which are suitable to connect the dumpster to a waste collection device; the dumpster has one or more openings obtained in the body or in the lid and comprises one or more inserts, each of which is suitable to close a corresponding opening; the dumpster being characterised in that each insert has at least one portion made of translucent material and comprises a plate and a fixing system; the fixing system comprising, in turn, at least one damping means suitable to attenuate vibration movements of the plate.

2. A dumpster according to claim 1, wherein the fixing system comprises at least one connecting element, which is suitable to connect the relative insert to the dumpster and is suitable to keep the plate in contact with a corresponding damping means.

3. A dumpster according to claim 1, wherein each fixing system comprises a frame.

4. A dumpster according to claim 3 and comprising at least one damping means arranged between the plate and the frame.

5. A dumpster according to claim 3, wherein the frame has a side which is hinged to the dumpster and a free end which is suitable to be arranged either in an opening position or in a closing position.

6. A dumpster according to claim 3, wherein the frame comprises at least one guide; the plate being engaged in a slidable way inside the guide.

7. A dumpster according to claim 1, wherein each damping means comprises at least one elastic element.

8. A dumpster according to claim 1, wherein a damping means comprises an annular element made of elastic material.

9. A dumpster according to claim 1 having a vertical axis and each plate having one or more notches placed at a distance from each other along the vertical axis.

* * * * *